US012673801B2

(12) United States Patent
Peng et al.

(10) Patent No.: US 12,673,801 B2
(45) Date of Patent: Jul. 7, 2026

(54) SPRING PORTABLE DECORATIVE BOX AND FOLDABLE SUPPORTING COLUMN

(71) Applicant: LINHAI YINHE ELECTRIC LAMP COMPANY, Taizhou (CN)

(72) Inventors: Yibo Peng, Taizhou (CN); He Qu, Taizhou (CN)

(73) Assignee: LINHAI YINHE ELECTRIC LAMP COMPANY, Taizhou (CN)

( * ) Notice: Subject to any disclaimer, the term of this patent is extended or adjusted under 35 U.S.C. 154(b) by 82 days.

(21) Appl. No.: 18/806,029

(22) Filed: Aug. 15, 2024

(65) Prior Publication Data

US 2026/0001679 A1 Jan. 1, 2026

(30) Foreign Application Priority Data

Jul. 1, 2024 (CN) ..... 202410871417.9

(51) Int. Cl.
*B65D 6/16* (2006.01)
*A47G 33/00* (2006.01)

(52) U.S. Cl.
CPC ..... *B65D 11/18* (2013.01); *A47G 33/00* (2013.01)

(58) Field of Classification Search
CPC ..... A47G 2021/002; A47G 2019/2277; A47G 33/00; B65D 2501/24184; B65D 88/52; B65D 21/086; B65D 7/30; B65D 9/12; B65D 9/22; B65D 7/26; B65D 7/24; B65D 1/225; B65D 11/18
See application file for complete search history.

(56) References Cited

U.S. PATENT DOCUMENTS 5,897,012 A * 4/1999 Sortwell ..... B65D 19/12 220/666
7,159,710 B2 1/2007 O'Brien et al.
7,635,064 B2 12/2009 Wang
7,784,631 B2 * 8/2010 Winn ..... B65D 19/08 220/666

(Continued)

FOREIGN PATENT DOCUMENTS

CN 219383165 U 7/2023

OTHER PUBLICATIONS https://www.engineeringskills.com/posts/column-buckling-structures-and-stability (Year: 2020).*
Column Buckling and Stability (Year: 2020).*

*Primary Examiner* — Kareen K Thomas
(74) *Attorney, Agent, or Firm* — Westbridge IP LLC

(57) ABSTRACT

Disclosed are a spring portable decorative box and a foldable supporting column. The spring portable decorative box includes two frame bodies arranged up and down, a plurality of foldable supporting columns are arranged between the two frame bodies, the frame bodies and the supporting columns form a stereoscopic supporting skeleton of a gift box, a lock structure is arranged between the two frame bodies, the supporting column comprises two connecting rods and a spiral spring fixedly connected between the two connecting rods, the two connecting rods are both located on an axis of the spiral spring to make the two connecting rods and the spiral spring form a straight line, a pitch of a middle part of the spiral spring is smaller than pitches of two ends, when the two frame bodies approach to form a folded state and the lock structure above is locked.

7 Claims, 5 Drawing Sheets

(56) References Cited

U.S. PATENT DOCUMENTS

| | | | | |
|---|---|---|---|---|
| 8,047,391 | B2 * | 11/2011 | Lu | A01K 1/033 220/9.3 |
| 8,511,495 | B2 * | 8/2013 | Grigsby | B65D 85/68 206/335 |
| 8,955,704 | B2 | 2/2015 | Kwon | |
| 8,985,432 | B2 | 3/2015 | Cullen et al. | |
| 8,998,011 | B2 * | 4/2015 | Zhu | A47B 87/0292 220/6 |
| 9,527,626 | B1 | 12/2016 | Coronado | |
| 10,602,860 | B2 | 3/2020 | Clark et al. | |
| 10,863,806 | B2 | 12/2020 | Shaffett et al. | |
| 2004/0010954 | A1 | 1/2004 | O'Brien et al. | |
| 2009/0078709 | A1 | 3/2009 | Murrer, III | |
| 2013/0284734 | A1 | 10/2013 | Huang | |
| 2015/0122810 | A1 | 5/2015 | Yang et al. | |
| 2018/0015323 | A1 * | 1/2018 | Yang | A63B 69/0028 |

* cited by examiner

SPRING PORTABLE DECORATIVE BOX AND FOLDABLE SUPPORTING COLUMN

CROSS-REFERENCE TO RELATED APPLICATIONS

This application claims priority to Chinese Patent Application No. 202410871417.9, filed on Jul. 1, 2024, the content of which is incorporated herein by reference in its entirety.

TECHNICAL FIELD

The present application relates to the technical field of decorative articles, is particularly a Christmas day decorative box, and relates to a spring portable decorative box and a foldable supporting column.

BACKGROUND

Decorative boxes, as decorative articles for setting off an atmosphere, are widely used in occasions of festivals, birthdays, anniversaries, and the like, such as decorative gift boxes placed under a Christmas tree on Christmas day. Common decorative boxes are mainly composed of a decorative layer covered outside and a frame located inside. By arranging light strips inside the box, light can penetrate through the decorative layer from the interior to set off the atmosphere with various patterns on the decorative layer, so as to achieve a desired effect. Moreover, the decorative layer is supported by the frame to ensure the flatness and integrity of the decorative layer and the stability of the frame, wherein the integral-type box occupies a large space due to a large volume, thus being not convenient for long-distance transportation and long-term storage.

In order to reduce the waste of space during storage and transportation, a foldable decorative gift box is provided in the prior art, wherein side frames and top frames are connected by movable connectors and connecting fasteners. The gift box is folded during transportation to reduce a volume of the gift box, so that a space utilization rate during transportation is improved, and the frame is prevented from being bent during transportation. Moreover, colored lights are arranged on a box body to improve the aesthetics of the gift box. However, the gift box is formed by assembly, the frames are easy to incorrect mounting, and additional connecting lines are needed, thus being difficult to mount.

SUMMARY

The present application is intended to provide a spring portable decorative box aiming at the above problem in the prior art, and the technical problem to be solved by the present application is: how to avoid mounting while saving space.

The object of the present application can be achieved by the following technical solution: a spring portable decorative box comprises two frame bodies arranged up and down, a plurality of foldable supporting columns are arranged between the two frame bodies, the frame bodies and the supporting columns form a stereoscopic supporting skeleton of a gift box, and a lock structure is arranged between the two frame bodies, wherein the supporting column comprises two connecting rods and a spiral spring fixedly connected between the two connecting rods, the two connecting rods are both located on an axis of the spiral spring to make the two connecting rods and the spiral spring form a straight line, a pitch of a middle part of the spiral spring is smaller than pitches of two ends, when the two frame bodies approach to form a folded state and the lock structure above is locked, the supporting column is bent at the middle part of the spiral spring, and when the lock structure is unlocked, the supporting column is capable of resetting to a straight state under an action of the spiral spring.

The basic principle of the present application is that, after the supporting columns are folded, the two frame bodies are locked and connected through the lock structures, so that the stability of the gift box in the folded state is improved by locking the two frame bodies through the lock structures while reducing the waste of space in transportation and storage; according to the folding structure of the stereoscopic supporting skeleton, the original rigid connection of splicing members is replaced by the flexible connection of the spiral springs, and the pitch of the spiral spring is adjusted on the basis of an existing spiral spring, so that the pitch of the middle part of the spiral spring is smaller than the pitches of the two ends of the spiral spring, thus improving a lateral stiffness of the spiral spring, and ensuring a supporting strength of the stereoscopic supporting skeleton in an unfolded state without adding an additional connector between the two connecting rods; the two ends of the spiral spring are respectively fixed on the two connecting rods, so that an arm of force for action is prolonged while increasing a contact area between the spiral spring and the two connecting rods, thus reducing an influence of the improvement of the lateral stiffness of the spiral spring on the folding of the skeleton, and ensuring the normal use of the gift box; and a decorative surface covered on the stereoscopic supporting skeleton is smoothed without wrinkles through an elastic force generated by the spiral springs in a reset process, so that an aesthetic degree of the gift box in a use process is improved.

Accordingly, in the present application, the two connecting rods are connected through the spiral spring, so that the supporting column can be folded, and meanwhile, a user only needs to unlock the lock structure between the two frame bodies, and then the frame bodies are pushed to move upwards by a force generated by elastic deformation of the spiral spring in a folding process to form the decorative box, thus avoiding mounting.

In the spring portable decorative box above, the middle part of the spiral spring is located between end surfaces of the two connecting rods, end parts of the two connecting rods are provided with a groove, and a part of the spiral spring with a larger pitch is clamped with the groove. The two ends of the spiral spring with the larger pitch are clamped with the grooves, so that a contact area with the connecting rod is increased, and the end parts of the spiral spring will not be separated, so that the connection reliability is improved.

In the spring portable decorative box above, upper and lower ends of the supporting column are respectively hinged with the two frame bodies, the upper and lower ends of the supporting column are both provided with a blocking surface located on an outer side and an arc surface located on an inner side, and the blocking surface is capable of abutting against the frame body. The blocking surface abuts against the frame body, which avoids the failure caused by the separation of the spiral spring from the connecting rod due to the outward folding of the supporting rod.

In the spring portable decorative box above, hinging parts are symmetrically arranged on the frame body left and right, a cross beam is arranged between two supporting columns, and the supporting columns are hinged with the hinging part through the cross beam.

In the spring portable decorative box above, the hinging part is provided with a bump, the cross beam is provided with a stopping part, and when the supporting column resets to the straight state under the action of the spiral spring, the stopping part abuts against the bump. The bump is matched with the cross beam, which further avoids the outward folding of the supporting rod, thus improving the stability of the skeleton in a use process.

In the spring portable decorative box above, the lock structure comprises a locking member and a clamping post, the locking member and the clamping post are respectively located on front and rear sides of the frame body, and the locking members and the clamping posts on the two frame bodies are oppositely arranged respectively. The interference between the lock structure and the hinging part is avoided.

In the spring portable decorative box above, the supporting column, the cross beam and the frame body are all provided with a fixed part, the fixed part is used for mounting a light strip, the supporting skeleton is covered by a decorative surface, and when the lock structure is unlocked, the supporting springs push the upper frame body to move upwards and closely adhere to a decorative fabric at a top part. The fixed part is arranged on the skeleton, which is convenient to mount the light strip, so that the gift box is more beautiful in use.

A foldable supporting column comprises two connecting rods and a spiral spring fixedly connected between the two connecting rods, wherein the two connecting rods are both located on an axis of the spiral spring to make the two connecting rods and the spiral spring form a straight line, and a pitch of a middle part of the spiral spring is smaller than pitches of two ends.

In the present application, the two connecting rods are flexibly connected through the spiral spring, so that the supporting column can be folded, and meanwhile, a supporting strength of the spiral spring is improved by adjusting the pitches of the middle part and the two ends of the spiral spring, thus improving use experience.

In the spring portable decorative box above, the middle part of the spiral spring is located between end surfaces of the two connecting rods, end parts of the two connecting rods are provided with a groove, and a part of the spiral spring with a larger pitch is clamped with the groove.

In the spring portable decorative box above, upper and lower ends of the supporting column are respectively provided with a blocking surface and an arc surface, and the supporting column is folded towards the arc surface. The interference between the frame body and the supporting column in a folding process is avoided.

Compared with the prior art, the present application has the following advantages: in the present application, the side frame is separated up and down, the two connecting rods are connected through the spiral spring at the end parts, and the supporting column is folded by a change of pitch of the spiral spring while ensuring the support to the skeleton, so that a volume during storage and transportation is reduced; and it is only necessary to press the frame body to unlock, and then the folded state is switched to the unfolded state by elastic deformation formed after transverse bending, thus avoiding mounting.

DETAILED DESCRIPTION OF THE EMBODIMENTS

The following descriptions are specific embodiments of the present application, and with reference to the drawings, technical solutions of the present application are further described, but the present application is not limited to these embodiments.

A decorative box provided by the present application is mainly used for decoration in festivals such as Christmas, which comprises a frame and a decorative fabric coated outside the frame. The decorative fabric is supported by the frame, a light strip is arranged in the frame, and light emitted by the light strip penetrates through the decorative fabric, which cooperates with components attached to the decorative fabric to play a decorative role.

Figure 1:
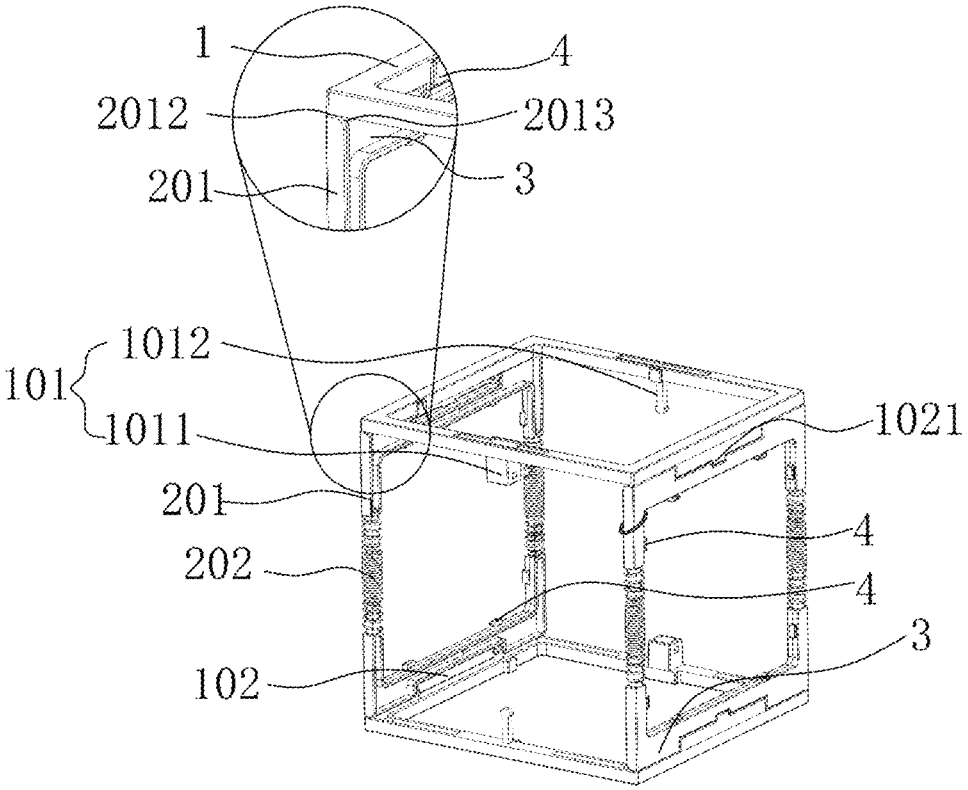
FIG. 1 is a schematic diagram of a stereoscopic structure of the present application.
Figure 2:
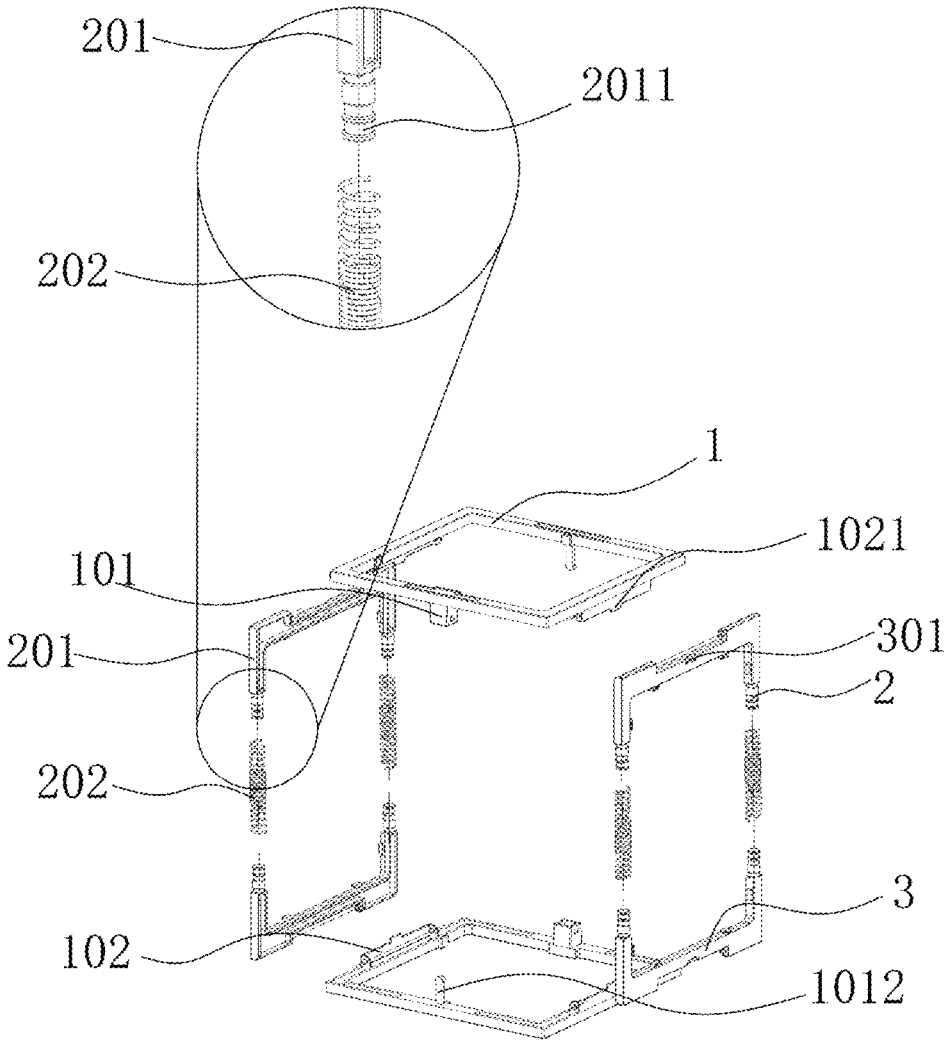
FIG. 2 is a schematic diagram of a stereoscopic exploded structure of the present application.

As shown in FIG. 1 and FIG. 2, the present application comprises two frame bodies 1 arranged up and down, and the two frame bodies 1 are connected by supporting columns 2. The supporting column 2 comprises two connecting rods 201 arranged up and down and a spiral spring 202 located between the two connecting rods 201. End parts of the two connecting rods 201 are provided with a groove 2011, the groove 2011 is used for mounting the spiral spring 202, and two supporting columns 2 are connected by a cross beam 3 to form two U-shaped frames which are arranged oppositely. The frame body 1 is provided with hinging parts 102, the hinging part 102 is provided with a bump 1021, the cross beam 3 is provided with a stopping part 301, and the stopping part 301 abuts against the bump 1021. Pitches of two ends of the spiral spring 202 are larger than a pitch of a middle part of the spiral spring 202, two ends of the spiral spring 202 with the larger pitch are clamped with the grooves 2011 of the two connecting rods 201 for fixing, and the cross beam 3 is hinged with the hinging part 102. The pitch essentially refers to a distance between two adjacent turns of the spring except top and bottom turns. Two sides of the hinging part 102 are provided with an opening, the cross beam is provided with a pin shaft arranged opposite to the opening, and the pin shaft is clamped into the opening to complete hinged connection, wherein one end of the pin shaft oriented to the hinging part is provided with an inclined surface. In a specific embodiment, the pin shaft may also be arranged on the hinging part to cooperate with the opening of the cross beam. A specific hinged structure is common knowledge in the art, which will not be repeated herein.

It is worth mentioning that, except that the bump 1021 on the hinging part 102 abuts against the stopping part 301 on the cross beam 3, upper and lower ends of the supporting column 2 are also provided with a blocking part and an arc surface 2013. As shown in FIG. 1, the blocking part is located outside the supporting column 2, and the arc surface 2013 is oriented to a lock structure 101. The lock structure 101 comprises a clamping post 1012 and a locking member 1011, the clamping post 1012 and the locking member 1011 are respectively located on front and rear sides of the frame body 1, and are opposite to the clamping post 1012 and the locking member 1011 on the other frame body 1, and the hinging parts 102 are located on left and right sides of the frame body 1. The locking member 1011 is a rebound device, and the rebound device is widely used in various products, which will not be repeated herein.

Figure 3:
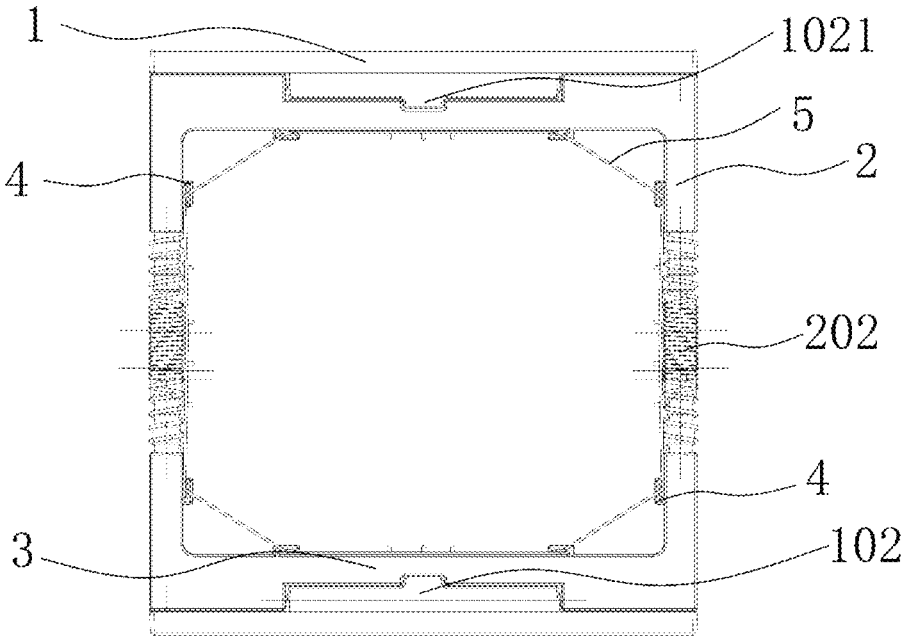
FIG. 3 is a front view of the present application during folding.
Figure 4:
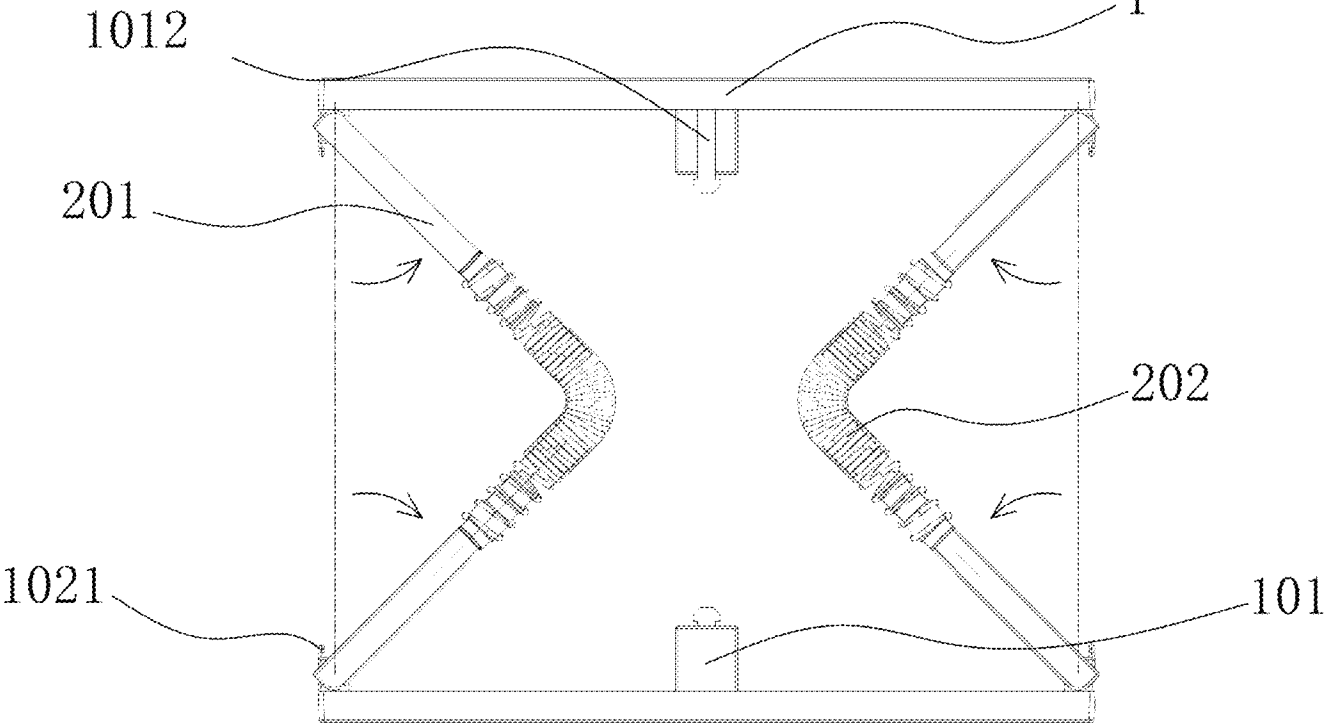
FIG. 4 is a cross-sectional front view of the present application in a folded state.

As shown in FIG. 3 and FIG. 4, when the stereoscopic supporting skeleton of the present application is folded, the supporting column 2 rotates inwards around a position where the supporting column 2 is connected with the frame body 1, that is, the supporting column 2 is bent towards the lock structure 101, until the locking member 1011 is clamped with the clamping post 1012, wherein the pitch of the middle part of the spiral spring 202 is larger than the pitches of the two ends.

Figure 5:
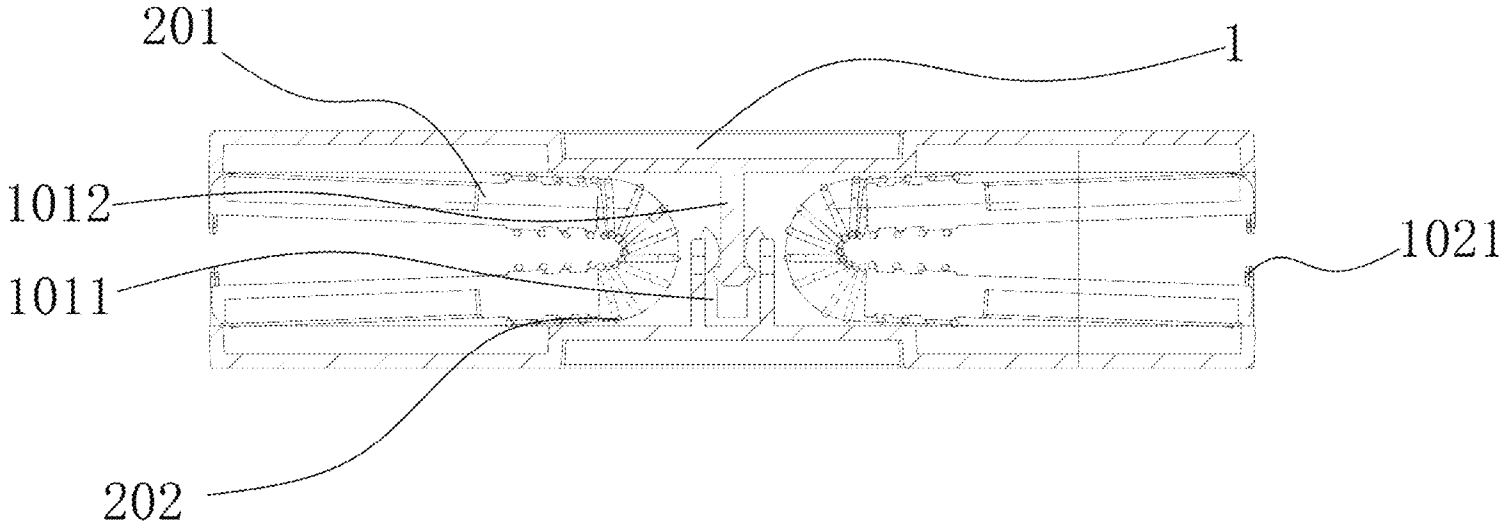
FIG. 5 is a side view of a stereoscopic skeleton of the present application in an unfolded state.

As shown in FIG. 5, the cross beam 3, the supporting column 2 and the frame body 1 are all provided with a fixed part 4, and the fixed part 4 is L-shaped, and reserves a certain space with the frame body 1, the supporting column 2 and the cross beam 3 for clamping the sheet-shaped light strip 5 in the fixed part 4.

To sum up, on the basis of an original stereoscopic supporting frame, in the present application, two additional beams 3 are added between the two supporting columns 2, the supporting columns 2 and the cross beams 3 are matched to form two oppositely arranged U-shaped frames, and the U-shaped frames and the frame bodies 1 are hinged with the hinging parts 102 through the cross beams 3, so that the U-shaped frames can swing around the hinging parts 102 towards the lock structures 101 on the frame bodies 1, thus enabling the frame bodies 1 to be folded, and reducing a volume of the stereoscopic supporting skeleton. In order to simplify the structure and reduce the mounting difficulty in a production process, existing rigid connection is replaced by flexible connection of the spiral spring 202. On this basis, in order to improve the support of the stereoscopic supporting skeleton to the decorative box, the pitch of the spiral spring 202 is adjusted, and a lateral stiffness of the middle part of the spiral spring 202 is improved by making the pitches of two ends of the spiral spring 202 larger than the pitch of the middle part, thus improving a supporting strength of the stereoscopic supporting skeleton. A certain buffer is provided after pressing down by increasing the pitches of two ends, and meanwhile, a joint strength is increased by arranging the groove 2011 on the connecting rod 201.

In addition, the two ends of the spiral spring 202 are respectively connected with the two connecting rods 201 of the supporting column 2, so that an arm of force of the supporting column 2 in a bent state is increased, and the consistency of the two supporting columns 2 in a folding process and a contact area of a folding part are ensured through the cross beam 3, so that the folding difficulty of the supporting column 2 is reduced, and an operator can overcome an influence of the reduced pitch of the middle part on the folding in the folding process. Moreover, due to the lateral bending of the spiral spring 202 in the folding process, elastic deformation occurs, so that when the locking members 1011 and the clamping posts 1012 of the two frame bodies 1 are unlocked, under an influence of the elastic deformation, the supporting columns 2 restore from the deformation to make the axes of the two connecting rods 201 and the spiral spring 202 in the same straight line, move outwards, and push the frame bodies 1 to move upwards, so as to stretch a decorative surface to form the decorative box. While reducing an accommodation space, it is only necessary to arrange a flexible connector of the spiral spring 202 between the end parts of the two connecting rods 201 to realize the switching from the folded state to the unfolded state by pressing the frame bodies 1, thus avoiding mounting the decorative box. Moreover, due to the existence of the spiral spring 202, the stereoscopic supporting skeleton can be suitable for decorative boxes with different heights, thus improving an application range, and internal decorations such as the light strip 5 may be directly fixed on the fixed parts 4, thus further improving use experience.

The specific embodiments described herein are only illustrative to the spirit of the present application. Those skilled in the technical field to which the present application belongs may make various modifications or supplements to the specific embodiments described or make substitutions in a similar way, without departing from the spirit of the present application or exceeding the scope defined by the appended claims.

Although the terms, such as 1: frame body; 101: lock structure; 1011: locking member; 1012: clamping post; 102: hinging part; 1021: bump; 2: supporting column; 201: connecting rod; 2011: groove; 2012: blocking surface; 2013: arc surface; 202: spiral spring; 3: cross beam; 301: stopping part; and 4: fixed part, are frequently used herein to describe and explain the essence of the present application more conveniently, the interpretation of the terms as any additional restriction violates the spirit of the present application.

What is claimed is:

1. A spring portable decorative box, comprising:

two frame bodies arranged up and down, a plurality of foldable supporting columns being arranged between the two frame bodies, the frame bodies and the supporting columns forming a stereoscopic supporting skeleton of the decorative box, and a lock structure being arranged between the two frame bodies, wherein the supporting column comprises two connecting rods and a spiral spring fixedly connected between the two connecting rods, the two connecting rods are both located on an axis of the spiral spring to make the two connecting rods and the spiral spring form a straight line; and when the two frame bodies approach to form a folded state and the lock structure above is locked, the supporting column is bent at the middle part of the spiral spring, and when the lock structure is unlocked, the supporting column is capable of resetting to a straight state under an action of the spiral spring;

wherein hinging parts are symmetrically arranged on the frame body left and right, a cross beam is arranged between two supporting columns, each of the hinging parts is provided with a bump, the cross beam is provided with a stopping part, and when the supporting column resets to the straight state under the action of the spiral spring, the stopping part abuts against the bump.

2. The spring portable decorative box according to claim 1, wherein the middle part of the spiral spring is located between end surfaces of the two connecting rods, end parts of the two connecting rods are provided with a groove, and a part of the spiral spring with a larger pitch is clamped with the groove.

3. The spring portable decorative box according to claim 2, wherein upper and lower ends of the supporting column are respectively hinged with the two frame bodies above, the upper and lower ends of the supporting column are both provided with a blocking surface located on an outer side and an arc surface located on an inner side, and the blocking surface is capable of abutting against the frame body.

4. The spring portable decorative box according to claim 1, wherein each of the supporting columns is hinged with the hinging part through the cross beam.

5. The spring portable decorative box according to claim 4, wherein the lock structure comprises a locking member and a clamping post, the locking member and the clamping post are respectively located on front and rear sides of the frame body, and the locking members and the clamping posts on the two frame bodies are oppositely arranged respectively.

6. The spring portable decorative box according to claim 5, wherein the supporting column, the cross beam and the frame body are all provided with a fixed part, the fixed part is used for mounting a light strip, the supporting skeleton is covered by a decorative surface, and when the lock structure is unlocked, the supporting springs push the upper frame body to move upwards and closely adhere to a decorative fabric at a top part.

7. The spring portable decorative box according to claim 1, wherein a pitch of a middle part of the spiral spring is smaller than pitches of two ends.

* * * * *